United States Patent [19]

Pease

[11] Patent Number: 4,639,122

[45] Date of Patent: Jan. 27, 1987

[54] CONTROL FOR RETRACTING THE CLEANING BLADE OF A REPRODUCTION OR PRINTING MACHINE WHEN THE MACHINE IS NOT IN USE

[75] Inventor: Donald L. Pease, Honeoye, N.Y.

[73] Assignee: Xerox Corporation, Stamford, Conn.

[21] Appl. No.: 818,929

[22] Filed: Jan. 15, 1986

[51] Int. Cl.[4] ..... G03G 21/00

[52] U.S. Cl. ..... 355/15; 355/14 R

[58] Field of Search ..... 355/15, 14 R, 14 FU, 355/3 FU, 3 R

[56] References Cited

U.S. PATENT DOCUMENTS

| | | | |
|---|---|---|---|
| 3,883,292 | 5/1975 | Hamaker | 432/60 |
| 3,936,658 | 2/1976 | Traister et al. | 219/216 |
| 4,174,172 | 11/1979 | Lane | 355/15 |
| 4,264,191 | 4/1981 | Gerbasi et al. | 355/15 |

FOREIGN PATENT DOCUMENTS

| | | | |
|---|---|---|---|
| 58-78183 | 5/1983 | Japan | 355/15 |
| 59-30575 | 2/1984 | Japan . | |
| 59-178475 | 10/1984 | Japan | 355/15 |
| 59-204874 | 11/1984 | Japan | 355/15 |

*Primary Examiner*—Arthur T. Grimley
*Assistant Examiner*—J. Pendegrass
*Attorney, Agent, or Firm*—Frederick E. McMullen

[57] ABSTRACT

To disengage the cleaning blade from the photoreceptor of a reproduction machine and avoid cold set and damage to the photoreceptor during prolonged machine shutdowns, a bi-metal coil spring is positioned inside the fusing roll to sense fuser temperatures, with linkage coupling the spring to the cleaning blade so that when fuser temperatures fall below a preset operating temperature, the spring relaxes permitting a weighted member to retract and disengage the blade from the photoreceptor.

8 Claims, 2 Drawing Figures

Figure 1:
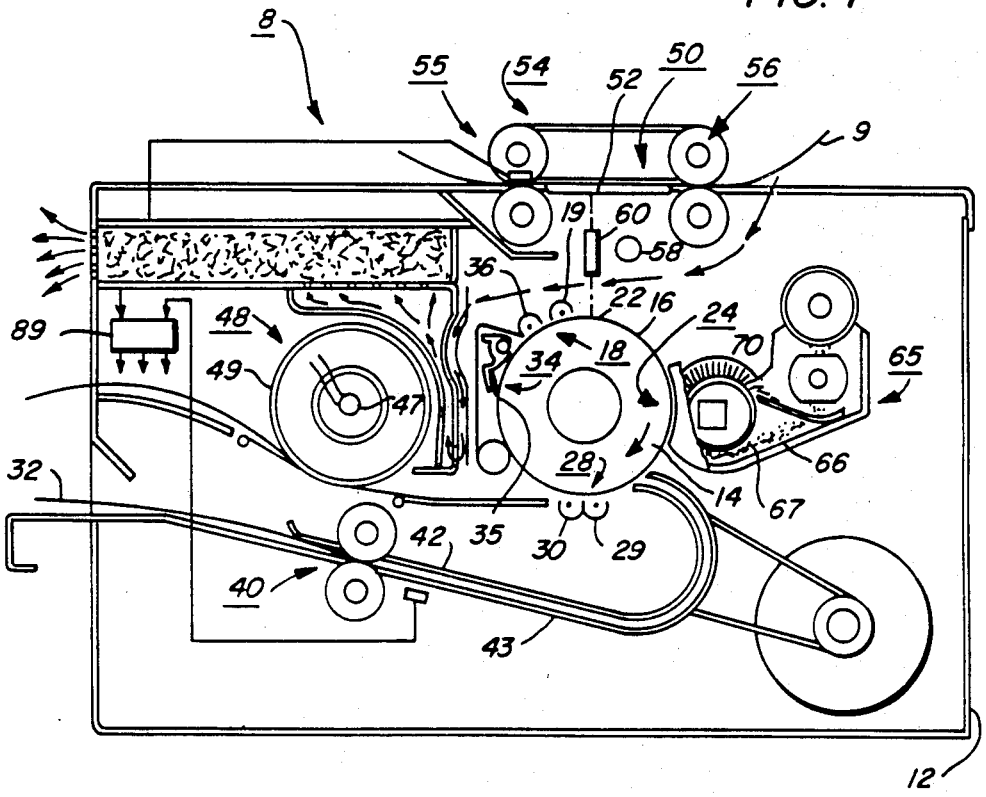

CONTROL FOR RETRACTING THE CLEANING BLADE OF A REPRODUCTION OR PRINTING MACHINE WHEN THE MACHINE IS NOT IN USE

The invention relates to an arrangement for prolonging the life of a reproduction machine recording member, and more particularly, to a means for disengaging the cleaning blade from the recording member when the machine is not in use.

In reproduction machines such as xerographic type copying machines, there is normally provided a cleaning station where any leftover toner or other debris clinging to the surface of the recording member are removed. While a number of ways exist to clean the recording member surface such as the cleaning brush disclosed by U.S. Pat. No. 3,883,292 (Hamaker), one popular way is to use a cleaning or wiper blade. In that type of system, one side or edge of the blade is held against the recording member surface so that as the recording member moves during copy processing, any leftover toner or other material left on the recording member surface is scraped off. To assure reliable and effective cleaning of the recording member surface, a certain amount of force must of necessity be applied to the blade to maintain the cleaning edge against the recording member surface with sufficient pressure to avoid allowing any particulate material on the recording member surface to slip past. One prior art example of a cleaning blade is found in U.S. Pat. No. 4,264,191 (Gerbasi et al).

However, during periods when the machine is not in use and the recording member is stationary, for example, overnight or on weekends, the sustained pressure of the cleaning blade against a single point on the recording member surface can cause cold flow or crystallization of the recording member and result in permanent damage to the recording member surface. When this happens, replacement or refurbishing of the recording member is usually necessary.

In the prior art, it is known to separate pressure and heated fusing rollers in a combination pressure/heat type fuser from one another when the machine is stopped. One example of this may be seen in U.S. Pat. No. 3,936,658 (Traister et al) where a control is provided to separate the fusing and pressure rolls from one another when the machine is not operational. In addition, as exemplified by Japanese patent publication No. 59-30575, it is known to use bi-metal spring to advance the cleaning web in a fuser when fuser temperatures reach a predetermined level.

To obviate damage to the recording member of a reproduction machine by the cleaning blade during periods of prolonged machine shutdown, the present invention provides the following in combination: a recording member having an imaging surface on which latent electrostatic images are formed; developing means for developing the images on the recording member surface; transfer means for transferring the developed images to copy substrate material; fuser means for fixing the developed images transferred to the copy substrate material; and cleaning means for cleaning the recording member surface after transfer, the cleaning means including a blade having a cleaning edge, means supporting the blade for movement between an operative position where the blade cleaning edge engages the recording member surface and an inoperatiive position where the blade cleaning edge is disengaged from the recording member surface, bias means for biasing the blade so that the blade cleaning edge is in one of the operative and inoperative positions; and temperature monitoring means for monitoring temperature conditions of the fuser means and responding to a preset temperature condition of the fuser means to overcome the bias means and move the blade so that the blade cleaning edge is in the other of the operative and inoperative positions.

IN THE DRAWINGS

Figure 2:
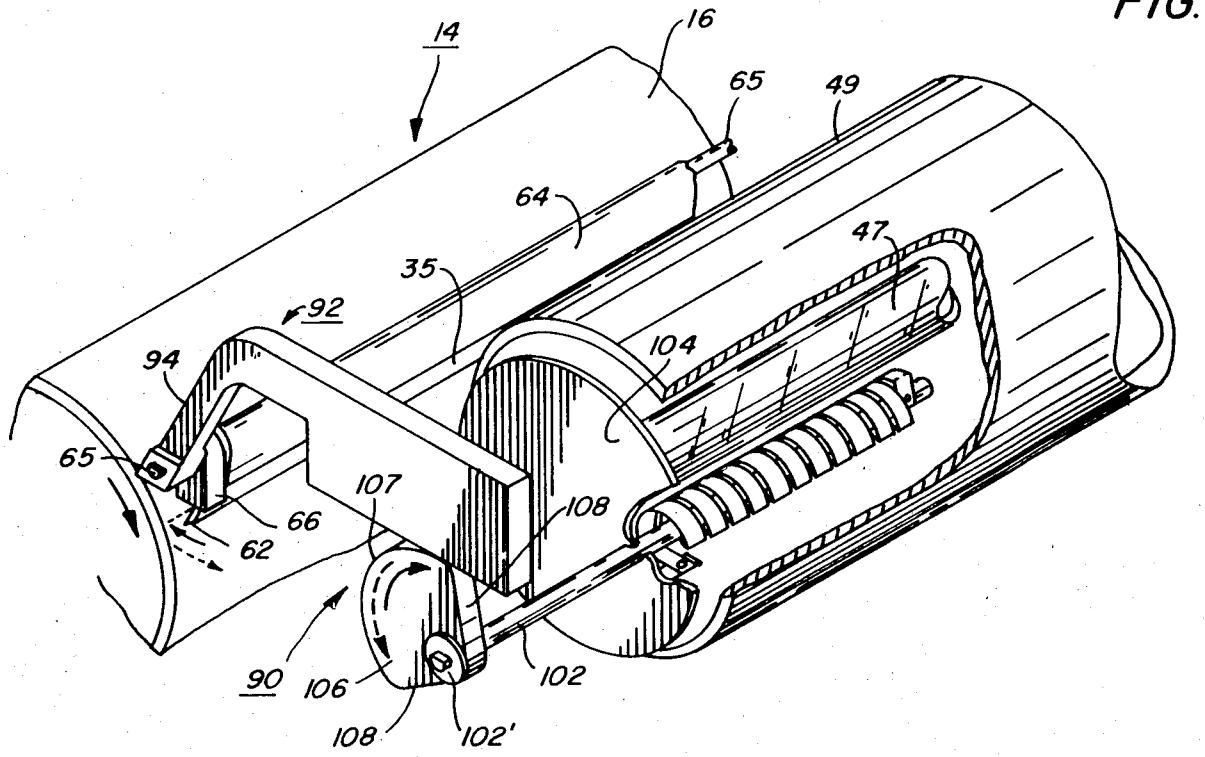

FIG. 1 is a side view section of a copying/printing machine having the cleaning blade retractor of the present invention; and FIG. 2 is an isometric view depicting the cleaning blade retractor of the present invention and the relationship thereof to the machine fusing roll and photoreceptor.

Referring to FIG. 1 of the drawings, there is shown a xerographic type reproduction machine 8 incorporating the present invention. Machine 8 has a suitable frame 12 on which the machine xerographic components are operatively supported. Briefly, and as will be familiar to those skilled in the art, the machine xerographic components include a recording member, shown here in the form of a rotatable photoreceptor 14. In the exemplary arrangement shown, photoreceptor 14 comprises a drum having a photoconductive surface 16. Other photoreceptor types such as belt, web, etc. may instead be contemplated. Operatively disposed about the periphery of photoreceptor 14 are charge station 18 with charge corotron 19 for placing a uniform charge on the photoconductive surface 16 of photoreceptor 14, exposure station 22 where the previously charged photoconductive surface 16 is exposed to image rays of the document 9 being copied or reproduced, development station 24 where the latent electrostatic image created on photoconductive surface 16 is developed by toner, transfer station 28 with transfer corotrons 29,30 for transferring the developed image to a suitable copy substrate material such as a copy sheet 32 brought forward in timed relation with the developed image on photoconductive surface 16, and cleaning station 34 with cleaning blade 35 and discharge corotron 36 for removing leftover developer from photoconductive surface 16 and neutralizing residual charges thereon.

Copy sheets 32 are brought forward to transfer station 28 by feed roll pair 40, sheet guides 42,43 serving to guide the sheet through an approximately 180° turn prior to transfer station 28. Following transfer, the sheet 28 is carried forward to a fusing station 48 where the toner image is fixed by fusing roll 49. Fusing roll 49 is heated by a suitable heater such as lamp 47 disposed within the interior of roll 49. After fixing, the copy sheet 28 is discharged.

A transparent platen 50 supports the document 9 as the document is moved past a scan point 52 by a constant velocity type transport 54. As will be understood, scan point 52 is in effect a scan line extending across the width of platen 50 at a desired point being platen 50 where the document is scanned line by line as the document is moved along platen 50 by transport 54. Transport 54 has input and output document feed roll pairs 55,56 respectively on each side of scan point 52 for moving document 9 across platen 50 at a predetermined speed. Exposure lamp 58 is provided to illuminate a strip-like area of platen 50 at scan point 52. The image rays from the document line scanned are transmitted by a gradient index fiber lens array 60 to exposure station 22 to expose the photoconductive surface 16 of the moving photoreceptor 14.

Developing station 24 includes a developer housing 65, the lower part of which forms a sump 66 for holding a quantity of developer 67. As will be understood by those skilled in the art, developer 67 comprises a mixture of large carrier particles and smaller toner or ink particles. A rotatable magnetic brush developer roll 70 is disposed in predetermined operative relation to the photoconductive surface 16 in developer housing 65, roll 70 serving to bring developer from sump 66 into developing relation with photoreceptor 14 to develop the latent electrostatic images formed on the photoconductive surface 16.

Referring now to FIG. 2, cleaning blade 35 comprises an elongated relatively rigid plate-like part disposed alongside photoreceptor 14 at cleaning station 34. The lower edge 62 of blade 35 provides a cleaning edge which contacts the photoconductive surface 16 of photoreceptor 14 to remove debris, such as leftover toner, from surface 16. Cleaning edge 62 is substantially parallel with the axis of drum 14 with an overall length substantially equal to or slightly greater than the width of photoconductive surface 16. Since blade 35 contacts the photoconductive surface 16 of photoreceptor 14, blade 35 is formed from a relatively soft material such as plastic to avoid damaging the photoconductive surface 16.

Blade 35 is carried by a support member 64 rotatably journaled in suitable frame members 66 by means of cross shaft 65. Shaft 65 is mounted so that the axis of rotation of blade 35 and the longitudinal axis of cleaning edge 62 are parallel to the axis of rotation of drum 14 to assure uniform contact of the cleaning edge 62 with the photoconductive surface 16.

To prevent cleaning edge 62 of blade 35 from deforming or damaging the surface 16 of drum 14 during periods when machine 8 is shutdown, the cleaning blade retractor, designated generally by the numeral 90, of the present invention is provided. As will appear, when machine temperatures are below a preset temperature level, retractor 90 retracts blade 35 to separate cleaning edge 62 thereof from photoconductive surface 16. At machine temperatures above the preset temperature level, retractor 90 responds by moving blade 35 to bring cleaning edge 62 thereof into operating contact with the surface 16 of photoreceptor 14.

Cleaning blade retractor 90 includes a weight 92 providing a preset force for driving and holding edge 62 of blade 35 in operative contact with the photoconductive surface 16. Weight 92 is non-rotatably coupled to one end of cross shaft 65 through arm 94 thereof. The force established by weight 92 drives or biases support member 64 and the blade 35 attached thereto in the clockwise direction shown by the solid line arrow in FIG. 2 to rotate blade 35 about the axis of cross shaft 65 and bring edge 62 of blade 35 into contact with surface 16 of photoreceptor 14.

A temperature responsive element or thermostat in the form of a coiled bi-metal spring 100 is employed to retract blade 35 when machine temperatures are below a preset temperature level. Bi-metal spring 100 is supported on and drivingly connected to a rod 102. Rod 102 is in turn rotatably journaled in support 104 of fuser lamp 47 with the end of rod 102 supporting bi-metal spring 100 projecting into the interior of fusing roll 49 along one side of fuser heat lamp 47. The opposite end 102' of rod 102 has a cam 106 fixed thereon, cam 106 being positioned so that the lower side 93 of weight 92 rests or rides thereon. The camming surface of cam 106 includes a radially outwardly projecting curved segment 107 with recessed flat segments 108, cam segments 107, 108 cooperating to provide, on rotation of cam 106 through a predetermined arc, the requisite degree of motion necessary to move weight 92 and edge 62 of cleaning blade 35 into or out of operative contact with surface 16 of photoreceptor 14.

In operation, when machine 8 is shutdown and fuser lamp 47 turned off, fusing roll 49 cools. Bi-metal spring 100 is selected so that when temperatures within fusing roll 49 fall below a preset temperature, bi-metal spring 100 contacts, rotating rod 102 and cam 106 thereon in the counter clockwise direction shown by the dotted line arrow of FIG. 2. Counter clockwise rotation of cam 106 forces weight 92 upwardly as cam segment 107 engages side 93 of weight 92. The resulting lifting movement of weight 92 rotates cross shaft 65 and the cleaning blade 35 attached thereto in the counterclockwise direction to separate the edge 62 of cleaning blade 35 from the surface 16 of photoreceptor 14.

The temperature response of bi-metal spring 100 normally chosen so that cleaning blade 35 will be retracted when machine 8 has been shutdown or inoperative for a relatively long interval. Typically, the time interval is a span of several hours over which machine 8 is not operated. It will be understood however, that the temperature selected for retracting cleaning blade 35 may be varied to suit individual machine needs, applications, and uses, and further that the response temperature of any individual machine may vary with the environmental conditions to which the machine is exposed as well as the normal variations of the machine operating components.

On subsequent startup of machine 8, fuser heat lamp 47 is energized to bring fusing roll 49 up to operating temperature. As temperatures within the interior of fusing roll 49 rise, bi-metal spring 100 expands, rotating rod 102 and cam 106 thereon in the clockwise direction shown by the solid line arrows. As temperatures of fusing roll 49 reach the preset temperature condition to which bi-metal spring 100 responds, cam 106 is rotated to bring flat cam segment 108 thereof into engagement with side 93 of weight 92. This movement of cam 106 allows weight 92 to move downward, rotating cross shaft 65 and the cleaning blade 35 attached thereto in the clockwise direction to bring edge 62 of blade 35 into desired pressure contact with the surface 16 of photoreceptor 14.

While a temperature responsive element in the form of a coiled bi-metal spring is shown and described, other temperature responsive drivers may instead be used. And while the temperature responsive element has been shown and described as being supported in the interior of fusing roll 47, the temperature responsive element may be placed external to the fusing roll 49 to sense temperatures at or adjacent the fusing roll surface and/or within the fuser housing. Further, while a single temperature responsive element is shown and described, plural temperature responsive elements may be used, as for example, where one temperature responsive element is positioned within fusing roll 47 to sense internal roll temperature conditions and a second temperature responsive element is positioned external to fusing roll 47 to sense exterior roll temperature conditions.

It is further understood that while weight 92 is illustrated as biasing cleaning blade 35 into engagement with surface 16 of photoreceptor 14, weight 92 may instead be employed to bias blade 35 to a disengaged position. In that instance, bi-metal spring 100 would be utilized to bring cleaning blade 35 into engagement with the surface 16 of photoreceptor 14 when temperatures within fusing roll 47 reached a preset level against the bias of weight 92. And, while a weight 92 of predetermined size has been described and shown herein as providing the force for biasing cleaning blade 35 in one of an engaged or disengaged position, other biasing means such as a spring may instead by envisioned.

While the invention has been described with reference to the structure disclosed, it is not confined to the details set forth, but is intended to cover such modifications or changes as may come within the scope of the following claims.

I claim:

1. In a reproduction machine having a recording member with an imaging surface on which latent electrostatic images are formed, developing means for developing images on the recording member surface, transfer means for transferring developed images to copy substrate material, fuser means for fixing developed images transferred to the copy substrate material, and cleaning means for cleaning the recording member surface after transfer, the cleaning means including a blade having a cleaning edge; the combination of:

(a) means for supporting said blade for movement between an operative position where said blade cleaning edge engages the recording member surface and an inoperative position where said blade cleaning edge is disengaged from the recording member surface;

(b) bias means for biasing said blade so that said blade cleaning edge is in one of said operative and inoperative positions; and (c) temperature monitoring means for monitoring temperature conditions of said fuser means, said temperature monitoring means responding to a preset temperature condition of said fuser means to overcome said bias means and move said blade so that said blade cleaning edge is in the other of said operative and inoperative positions.

2. The machine according to claim 1 in which said bias means comprises a weight of predetermined size.

3. The machine according to claim 2 in which said fuser means includes (a) a hollow fusing roll adapted to contact said copy substrate material, and heater means in the interior of said fusing roll for heating said roll;

(b) said temperature monitoring means comprising a bi-metal spring disposed within the interior of said fusing roll, and coupling means drivingly connecting said spring to said blade so that as said spring expands and contracts in response to changes in fuser temperatures, said spring exerts a bias on said blade through said coupling means tending to move said blade and bring said blade cleaning edge to one of said operative or inoperative positions; and (c) second coupling means drivingly connecting said weight to said blade, said weight exerting a force on said blade through said second coupling means tending to move said blade and bring said blade cleaning edge to one of said operative or inoperative positions in opposition to the bias imposed by said spring.

4. The machine according to claim 3 in which said first mentioned coupling means includes a cam operated by said spring, said cam having a camming surface engaging said weight to move said weight in response to changes in fuser temperatures.

5. In a reproduction machine having a recording member with an imaging surface on which latent electrostatic images are formed, developing means for developing images on the recording member surface, transfer means for transferring developed imges to copy substrate material, fuser means for fixing developed images transferred to the copy substrate material, and cleaning means for cleaning the recording member surface after transfer, the cleaning means including a generally rectangular blade member, one side of the blade member providing a cleaning edge adapted to wipe against the recording member surface to remove debris and clean the recording member surface, the length of the blade member side being at least equal to the width of the recording member surface; the combination of:

(a) means for supporting the blade for movement between an operative position where the blade cleaning edge engages the recording member surface and an inoperative position where the blade cleaning edge is disengaged from the recording member surface;

(b) bias means for biasing said blade member to said operative position where said blade member cleaning edge engages said recording member surface; and (c) temperature monitoring means for monitoring temperature conditions of said fuser means, said temperature monitoring means responding to a preset temperature condition of said fuser means to overcome said bias means and move said blade member to said inoperative position where said blade member cleaning edge is disengaged from said recording member surface.

6. The machine according to claim 5 in which said bias means comprises a weight of predetermined size.

7. The machine according to claim 6 in which said fuser means includes (a) a hollow fusing roll, and heater means in the interior of said fusing roll for heating said roll;

(b) said temperature monitoring means comprising a bi-metal spring element disposed within the interior of said fusing roll and drivingly coupled to said blade member, said spring on said preset temperature condition displacing said weight and moving said blade member to said inoperative position to disengage said blade member cleaning edge from said recording member surface.

8. In a reproduction machine having a recording member with an imaging surface on which latent electrostatic images are formed, developing means for developing images on the recording member surface, transfer means for transferring developed images to copy substrate material, and fuser means for fixing developed images transferred to the copy substrate material, the combination of:

(a) a blade member having a cleaning edge engageable with the recording member surface for cleaning the recording member surface after transfer of said developed images to said copy substrate material;

(b) means supporting said blade member for movement between a first position where said blade member cleaning edge is disengaged from said recording member surface and a second position where the blade member cleaning edge is engaged with said recording member surface;

(c) bias means for biasing said blade member to one of said first and second positions whereby said blade member cleaning edge is disengaged from or engaged with said recording member surface; and (d) temperature monitoring means for monitoring temperature conditions of said fuser means, said temperature monitoring means responding to a preset temperature condition of said fuser means to overcome said bias means and move said blade to the other of said first and second positions whereby said blade member cleaning edge is engaged with or disengaged from said recording member surface.

* * * * *